US007934290B2

(12) United States Patent
Gherardi et al.

(10) Patent No.: US 7,934,290 B2
(45) Date of Patent: May 3, 2011

(54) DOOR HINGE DEVICE WITH FULCRUM AT VARIABLE POSITION

(75) Inventors: Eros Gherardi, Bologna (IT); Ermes Degli Esposti, Bologna (IT); Teresa Ghedini, Bologna (IT)

(73) Assignee: C.M.I. S.r.l. (IT)

( * ) Notice: Subject to any disclaimer, the term of this patent is extended or adjusted under 35 U.S.C. 154(b) by 12 days.

(21) Appl. No.: 12/096,864

(22) PCT Filed: Dec. 21, 2006

(86) PCT No.: PCT/IB2006/003751

§ 371 (c)(1),
(2), (4) Date: Jun. 10, 2008

(87) PCT Pub. No.: WO2007/072206

PCT Pub. Date: Jun. 28, 2007

(65) Prior Publication Data

US 2008/0276425 A1 Nov. 13, 2008

(30) Foreign Application Priority Data

Dec. 22, 2005 (IT) ..... BO2005A0782

(51) Int. Cl.
*E05F 1/08* (2006.01)

(52) U.S. Cl. ..... 16/288; 16/323; 16/280; 16/291

(58) Field of Classification Search ..... 16/288, 16/287, 366, 368, 370, 286, 289, 290, 254, 16/258, 323, 280, 291; 217/60 G
See application file for complete search history.

(56) References Cited

U.S. PATENT DOCUMENTS

| | | | | |
|---|---|---|---|---|
| 2,674,761 | A * | 4/1954 | Weiss | 16/288 |
| 2,698,957 | A * | 1/1955 | Vigmostad | 16/302 |
| 3,327,701 | A | 6/1967 | Smith | |
| 3,351,975 | A * | 11/1967 | Goto | 16/288 |
| 3,978,549 | A * | 9/1976 | Vitt | 16/245 |
| 4,587,760 | A * | 5/1986 | Brissette | 49/252 |
| 6,715,183 | B1 * | 4/2004 | Lautenschlager | 16/286 |

(Continued)

FOREIGN PATENT DOCUMENTS

EP 0859197 A2 8/1998

(Continued)

*Primary Examiner* — David J Bagnell
*Assistant Examiner* — Matthew Sullivan
(74) *Attorney, Agent, or Firm* — Laubscher & Laubscher, PC

(57) ABSTRACT

An hinge device with fulcrum at variable position for a door (2) of a structure (3) is provided with connecting members, first (4) and second (5), mutually connected and respectively fit to be fixed to the door (2) and to the structure (3) for rotating the door between the extreme closing (C) and the extreme opening (A) in which the door (2), in an operating condition of the structure, is respectively almost vertical and approximately horizontally orientated.

The second connecting member (5) has a first fixed pivot (6) and a second fixed pivot (7) for the rotating connection respectively with a first balancing mean (8) and a second balancing mean (9) mutually bound.

The end opposite to the first fixed pivot (6) of the first balancing mean (8) is connected by means of a first mobile pivot (10) to an end of the first arm mean (11) having the remaining end connected to the first connecting member (4) by means of a second mobile pivot (12).

The end opposite to the second fixed pivot (7) of the second balancing means (9) is connected by means of a third mobile pivot (13) to the first connecting member (4).

20 Claims, 3 Drawing Sheets

U.S. PATENT DOCUMENTS

| | | | | |
|---|---|---|---|---|
| 7,003,851 | B2 * | 2/2006 | Salice | 16/285 |
| 7,093,877 | B2 * | 8/2006 | Duffy | 296/76 |
| 7,334,361 | B2 * | 2/2008 | Schrimpf et al. | 40/452 |
| 2006/0156513 | A1 * | 7/2006 | Zetti | 16/288 |

FOREIGN PATENT DOCUMENTS

| | | | |
|---|---|---|---|
| FR | 2662204 | A1 | 11/1991 |
| WO | WO03038219 | A1 | 5/2003 |

* cited by examiner

FIG.2
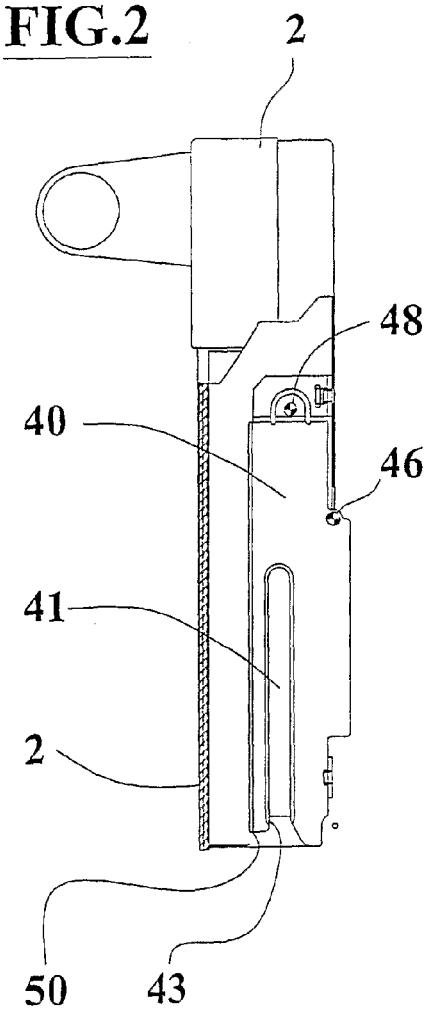
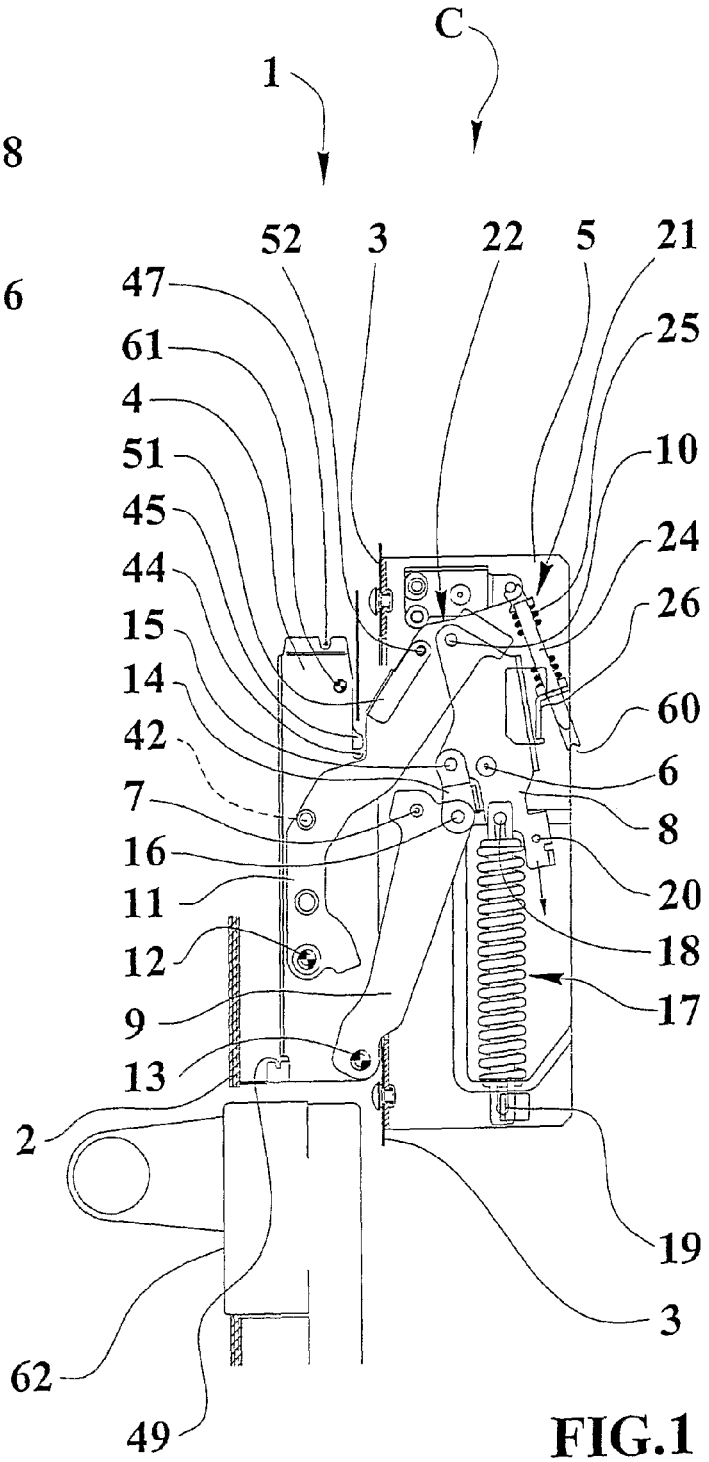
FIG.1

DOOR HINGE DEVICE WITH FULCRUM AT VARIABLE POSITION

TECHNICAL FIELD

The present invention relates to technical field of hinges and refers to a hinge device with fulcrum at variable position for a door with horizontal rotating axis, particularly suitable for household appliance such as ovens or the like.

BACKGROUND ART

They are known hinges for rotating a door with horizontal axis from a closing condition, in which said door is vertically orientated, to an opening condition in which the door is set in an almost horizontal position.

Some of said known hinges have the drawback to carry out an opening movement of the door that could interfere with below protruding objects or components, such as a base or a lower door, and therefore force to space apart the door from the below lower door or from the base increasing vertical size and forming a wide anaesthetic and unhygienic recess under the door.

DISCLOSURE OF THE INVENTION

An object of the present invention is to propose a hinge device with fulcrum at variable position for a door which can avoid interferences during the door opening with the objects below, such as a lower door, permitting the assembly of the door very close to the below object.

Further object is to propose a small sized device which is also suitable for large and heavy doors.

Other object is to propose a device able to assure a solid arrest of the door, also for a very heavy door, in the extreme opening condition.

Further object is to propose a hinge device able to increase the contrast against the weight force of the door in the last opening phases of the door.

Other object is to propose a simple device, extremely reliable, which does not require adjustments and can be assembled easily and quickly to the household appliances and to its door.

The above mentioned objects can be reached in accordance with the content of the claims.

BRIEF DESCRIPTION OF THE DRAWINGS

The characteristics of the present invention are evidenced in the following with reference to the attached drawings, in which:

FIG. 1 shows a schematic side view of the hinge device with fulcrum at variable position of the present invention, associated to the body of a household appliance and to a door in a closing condition and in which some parts are removed to evidence better others;

FIG. 2 shows an assembly member of the device, not shown in FIG. 1, fixed to the door;

BEST MODE OF CARRYING OUT THE INVENTION

Figure 3:
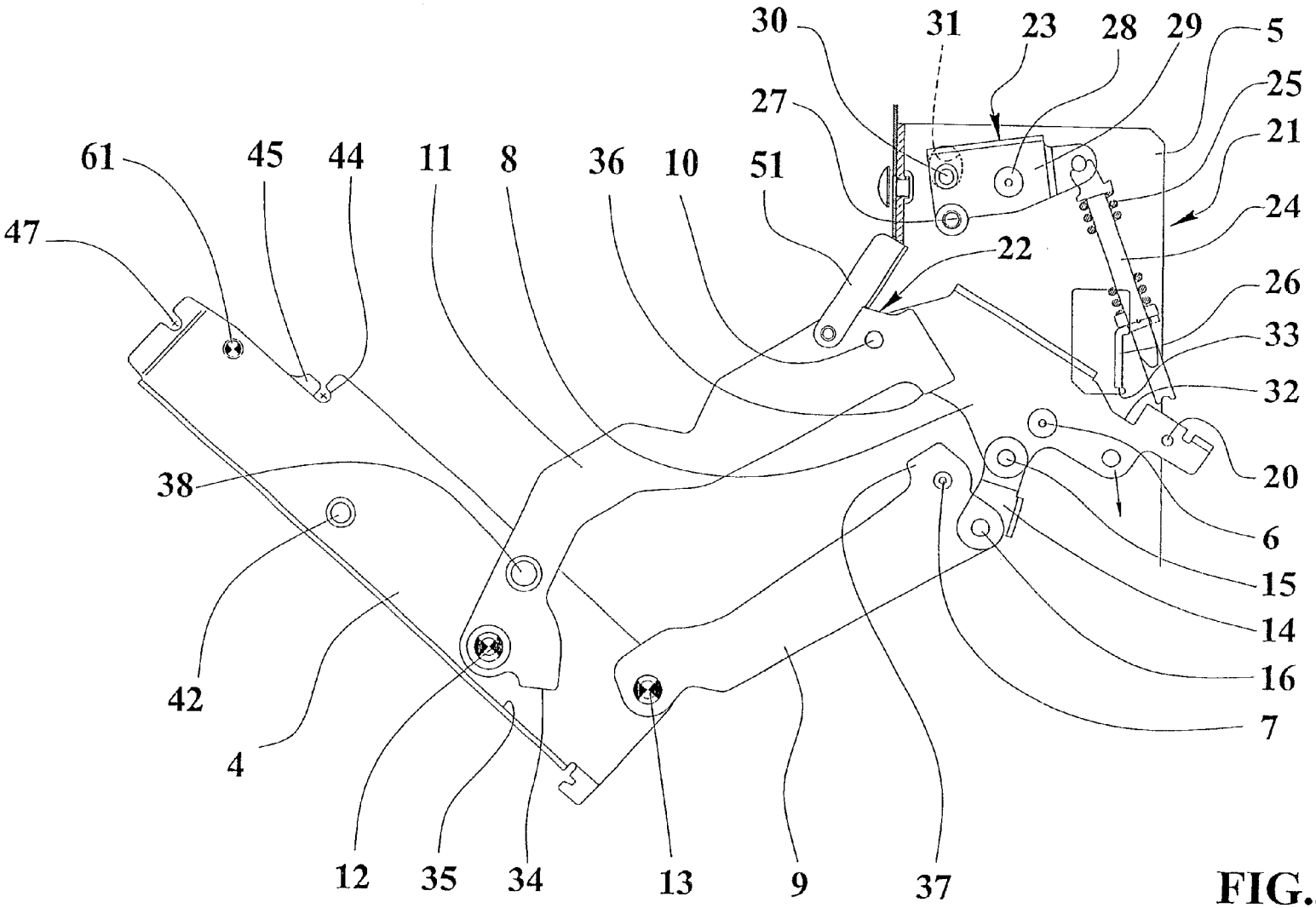
FIG. 3 shows a side view of the device of FIG. 1 blocked in a partial opening condition for the assembly of the device to its assembly member shown in FIG. 2.
Figure 4:
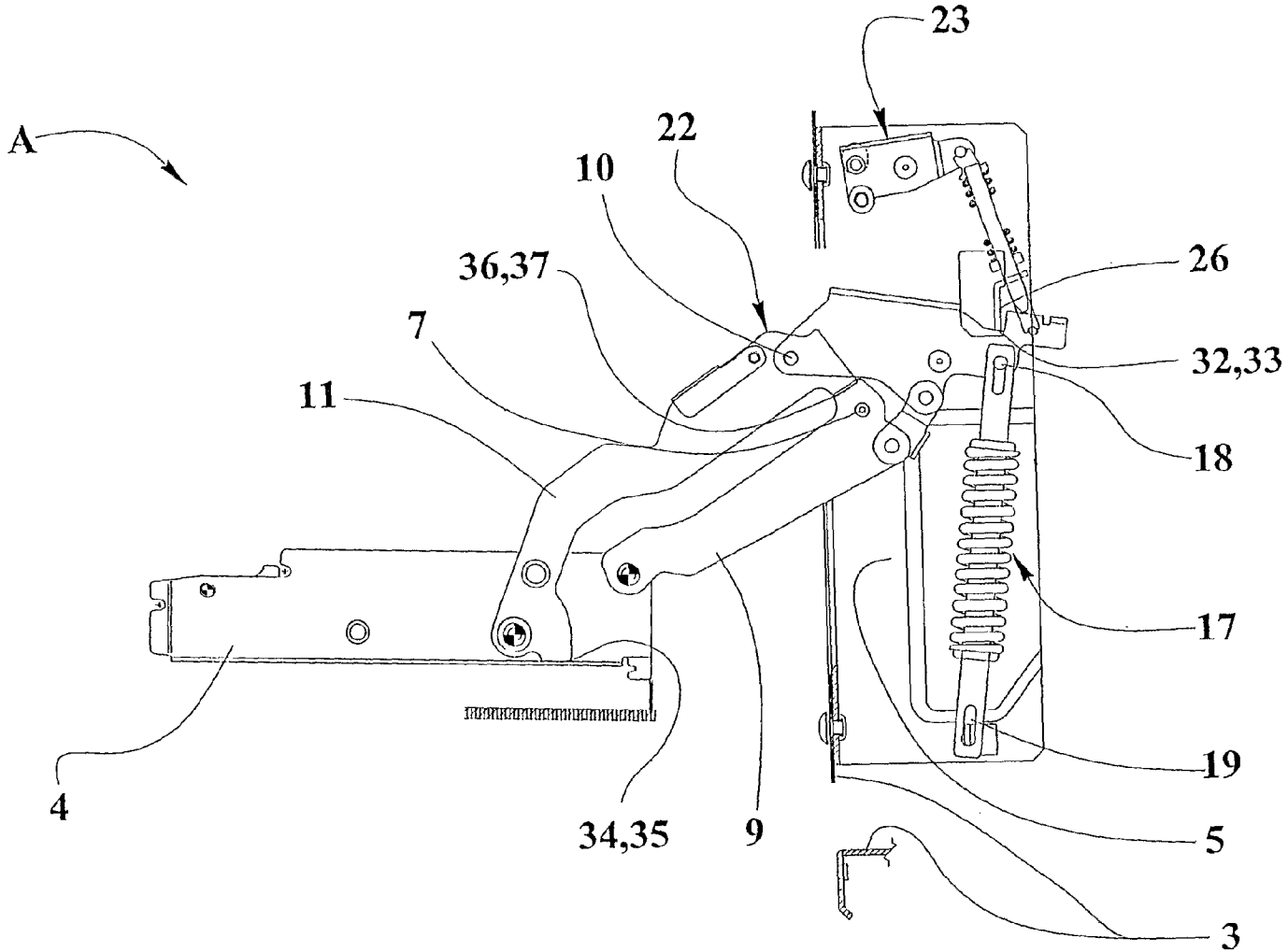
FIG. 4 shows a side view of the device of FIG. 1 in an extreme opening condition.

With reference to FIGS. 1-4, numeral 1 indicates the hinge device with fulcrum at variable position for a door 2 of a structure 3 consisting, for example, of an oven for domestic use, a household appliance with horizontal rotating axis of the door or a furniture element.

The hinge device 1 is provided with a first connecting member 4, fixed in a removable manner to the door 2 by means of a assembly member 40 fixed to the door, and a second connecting member 5 fixed to the structure 3 of the household appliance, laterally with respect to the opening, by means of screws or the like.

The two members are mutually connected by means of other elements of the device that, in the operating condition of the structure, allow the rotation of the door between the extreme closing condition C and the extreme opening condition A in which the door 2 is respectively almost vertically orientated and approximately horizontally orientated.

The second connecting member 5 has two fixed pivots, first 6 and second 7, parallel to the geometric rotation axis of the door.

The first fixed rotating pivot 6 connects pivotally a first balancing mean 8 to the second connecting member 5.

The second fixed rotating pivot 7 connects pivotally a second balancing mean 9 to the second connecting member 5.

The balancing means 8, 9 can be mutually bound by means of a second arm mean 14.

In alternative, the invention provides that balancing means 8, 9 can be mutually bound by means of a pivot, fixed to one of them, and sliding in a shaped slot carried out in the another, by means of gear sectors or by means of cursors and guides and the like.

The opposite end of the first fixed pivot 6 of the first balancing mean 8 is connected, by means of a first mobile pivot 10 parallel to the fixed pivots, at one end of a first arm mean 11 having the remaining end connected to the first connecting member 4 by means of a second mobile pivot 12 parallel to the fixed pivots.

The opposite end to the second fixed pivot 7 of the second balancing mean 9 is connected, by means of a third mobile pivot 13 parallel to the fixed pivots, to the first connecting member 4.

The second arm mean 14 is fixed to the first 8 and the second 9 balancing means by means of binding pivots respectively first 15 and second 16, also parallel to the fixed pivots.

The first fixed pivot 6 is positioned higher and moved inside the structure 3 respect to the second fixed pivot 7.

In the operating closing condition C, the first mobile pivot 10 is placed between the vertical passages for the fixed pivots 6, 7 higher than them; the second mobile pivot 12 is positioned higher and more externally of the third mobile pivot 13 and both are positioned lower and more externally than the second fixed pivot 7. The first 15 and the second 16 binding pivots are positioned between the vertical passages for the fixed pivots 6, 7. The first binding pivot 15 is at the same height, or bit higher, respect the first fixed pivot 6, while the second binding pivot 16 is at the same high or bit lower than then second fixed pivot 7.

The mobile and binding pivots 10, 12, 13, 16, 15 form the vertexes of an irregular and deformable pentagon.

The sides of the irregular pentagon comprised between the first binding pivot 15 and the first mobile pivot 10, between the first mobile pivot 10 and the second mobile pivot 12, between the second mobile pivot 12 and the third mobile pivot 13, between third mobile pivot 13 and the second binding pivot 16 and between the first binding pivot 15 and the second binding pivot 16 have the lengths approximately equal to 1.5; 4.4; 1.4; 3.3 and 0.7 times of the distance between the fixed pivots 6, 7.

The device comprises first elastic means 17 fit to provide the connecting members, first 4 and second 5, an elastic closing force.

The end of the first balancing mean 8 almost opposed to the first mobile pivot 10 with respect to the first fixed pivot 6, has a first coupling mean 18 for an end of the first elastic means 17 operating in traction and having the remaining end connected by means of a second coupling means 19 to the second connecting member 5.

The first elastic means comprise two tie-rod elements sliding into a helicoidal spring. The ends of each tie-rod element are at one end fixed to a respective end of the spring and at another end protruding from the opposite end of the spring.

The protruding end of each tie-rod element is connected to the respective coupling means, first 18 and second 19.

An end of the first balancing mean 8 opposite to the first mobile pivot 10 has a matching means 20, consisting, for example, of a cylindrical protrusion that in the conditions closed to the extreme opening condition, is fit to match an end 60, shaped in a manner almost complementary to the matching means 20, of respective second elastic means 21 transmitting to the first balancing mean 8 an elastic force in contrast with the weight force applied to the door 2 at said conditions close to the extreme opening.

The final portion of the first arm mean 11, having the first mobile pivot 10, has a cam surface 22 carried out in an edge of said end portion of the first arm mean 11 and fit, in the conditions next to the extreme closing condition, to match a follower mean 23 driven by respective second elastic means 21 that, in said conditions, keep it elastically adherent to said cam surface 22.

The cam surface 22 is shaped as opened "S" approximately and carries out at least a removable arrest of the door 2, in a partial opening condition for example suitable for the oven operating as grill.

Follower means 23 comprise a body 29, for example in shaped metallic sheet, centrally hinged, by means of a respective pivot 28, parallel to the fixed pivots, to second fixed member 5.

The body has an end bound to an end of second elastic means 21 and the remaining end has an idle wheel 27 fit to rotate along the cam surface 22 adherent to itself due to the elastic force effect of the second elastic means 21.

The second elastic means 21 of the matching mean 20 and of the follower mean 23 are constituted by the same element comprising at least a telescopic spring guide 24 for a spring 25 operating in compression and connected to the second connecting member 5 by means of guiding means 26, consisting, for example, in a portion of the sheet of the same second connecting member 5 partially cut and refolded. In alternative, the matching means 20 and the follower mean 23 can be provided with respective and separate elastic means but which causes a more complexity and a bigger dimension of the device.

The body 29 of the follower mean 23 has a pivot for limitation of the oscillation 30, protruding and mobile inside a slot 31 of the second connecting member 5.

The first balancing mean 8 is provided with a first limit stop mean 32 fit to match a first beating mean 33 fixed to the second connecting member 5 in the extreme opening condition A.

The first beating mean 33 is carried out in the guiding means 26 to obtain a more compact size of the device.

The first arm mean 11, has in proximity of the second mobile pivot 12 a second limit stop means 34 fit to match a second beating mean 35 of the first connecting member 4 in the extreme opening condition A.

The end next to first mobile pivot 10 of the first arm mean 11 has a third limit stop means 36 and the end next to the second fixed pivot 7 of the second balancing means 9 has a third stop means 37, said third limit stop means 36 and stop means 37 being fit for the mutual matching in the extreme opening condition A.

So the stability in the extreme opening condition is assured, in three various points of the device, also if the door is very heavy door or in case there are heavy load on the door.

The first arm mean 11, close to the second mobile pivot 12, has a protruding mean 38, for example obtained by means of perforation, sliding on a flat surface of the first connecting member 4 to reduce the mutual gaps and oscillations.

The assembly member 40 has a longitudinal concavity 41 fit to house, by means of sliding from the lower part towards the upper part, a protruding means 42 of the first connecting member 4 and a protrusion of the second mobile pivot 12 inserted in said longitudinal concavity 41 through a respective opening 43 which is positioned below when the door is in the extreme closing condition C.

The portion of the first connecting member 4 inside and opposite to the third mobile pivot 13 has a first seat 44 for a first assembly pivot 46 of the assembly member 40 and can be blocked in removable manner in said seat by means of a stopping mean 45, movable manually, of the first connecting member 4. The stopping mean 45 is connected to the first connecting member 4 by means of a pivot 61 and is elastically maintained faced to the first seat 44 from a helicoidal spring or from a leaf spring.

The end of the first connecting member 4 opposite to the third mobile pivot 13 has a second seat 47 for a second assembly pivot 48 of the assembly member 40.

The external portion of the first connecting member 4 next to third mobile pivot 13 has a third seat 49 for assembly means 50 consisting of an end of a bended border of the assembly member 40.

The seats 44, 47, 49 are opened toward the upper part in the extreme closing condition C.

The device comprises furthermore an assembly arm 51 having an end connected in swivelling manner, by means of a respective pivot 52, to the first arm mean 11 and movable manually to match, with the remaining end, an edge of the second connecting member 5 to block the first connecting member 4 to facilitate the assembling to the assembly member 40 of the door.

The operation of the device provides that the third mobile pivot 13, and the lower end of the door, describe during the opening a circular sector path, in external and upwardly direction, centered in the second fixed pivot 7.

Said path avoids the interference of the door with protrusions and objects positioned therebelow, for example the lower door 62.

The opening couple of the door produced by the weight force of the door itself is balanced by the elastic force of the first elastic means 17 and, when the driving arm of said force is closed to its maximum, also by the elastic force of the second elastic means 21.

An advantage of the present invention is to provide a hinge device with fulcrum at variable position for a door which can avoid interferences during the opening of the door with below objects, such as a lower door, allowing the assembly the door near the below objects.

Further advantage is to provide a device of small sizes but also suitable for large and heavy doors.

Other advantage is to provide a device which can assure a firm stop of the door, even if it is very heavy, in the extreme opening condition.

Further advantage is to provide a hinge device which can increase the contrast against the weight force of the door in the latest opening phases of the door.

Other advantage is to provide a simple and extremely reliable device which does not need adjustments and can be easily and quickly assembled to the household appliance and its door.

The invention claimed is:

1. A fulcrum type door hinge permitting movement of a door between horizontal open and vertical closed positions relative to a structure, comprising (a) a first member adapted for mounting to the door;

(b) a second member adapted for mounting to the structure;

(c) a first balancing arm connected with said second member via a first fixed pivot connection;

(d) a second balancing arm connected at one end with said second member via a second fixed pivot, said first fixed pivot being arranged above and within the structure relative to the second fixed pivot;

(e) a first arm having one end connected with an end of said first balancing arm opposite said first fixed pivot via a first mobile pivot and a second end connected with said first member via a second mobile pivot, said second balancing arm being connected at another end with said first member via a third mobile pivot; and (f) a second arm connected between said first balancing device and said second balancing device via first and second binding pivots, respectively, said first mobile pivot being arranged above and between said first and second fixed pivots when the door is in the closed position, said second mobile pivot being arranged above and more external than said third mobile pivot relative to the structure, said second and third mobile pivots being arranged below and external to said second fixed pivot, said first and second binding pivots being arranged between said first and second fixed pivots, said first binding pivot being arranged at least as high as said first fixed pivot, said second binding pivot being arranged at or below the height of said second fixed pivot.

2. A hinge as defined in claim 1, and further comprising a spring connected between said second member and said first balancing arm to provide a closing force for the door.

3. A hinge as defined in claim 2, wherein said mobile and binding pivots form the vertices of an irregular and deformable pentagon.

4. A hinge as defined in claim 3, wherein the sides of the irregular pentagon formed between said first binding pivot and said first mobile pivot, between said first mobile pivot and said second mobile pivot, between said second mobile pivot and said third mobile pivot, between said third mobile pivot and said second binding pivot and between said first binding pivot and said second binding pivot have lengths approximately equal to 1, 5; 4, 4; 1, 4; 3, 3 and 0, 7 times of the distance between said fixed pivots, respectively.

5. A hinge as defined in claim 2, and further comprising a first coupling device connecting one end of said spring with an end of said first balancing arm opposite said first fixed pivot and a second coupling device connecting another end of said spring with said second connecting member.

6. A fulcrum type door hinge permitting movement of a door between horizontal open and vertical closed positions relative to a structure, comprising (a) a first connecting member adapted for mounting to the door;

(b) a second connecting member adapted for mounting to the structure;

(c) a first balancing arm connected with said second connecting member via a first fixed pivot connection in a mid-portion of said first balancing arm;

(d) a second balancing arm connected at one end with said second connecting member via a second fixed pivot, said first fixed pivot being arranged above and within the structure relative to the second fixed pivot;

(e) a first arm having one end pivotally connected with an end of said first balancing arm opposite said first fixed pivot and a second end pivotally connected with said first connecting member, said second balancing arm being pivotally connected at another end with said first connecting member; and (f) a spring connected between said second connecting member and said first balancing arm for providing a force to said first balancing arm to counteract the weight of the door, said first balancing arm including a pin which engages an end of said spring when the door is in the horizontal open position.

7. A fulcrum type door hinge permitting movement of a door between horizontal open and vertical closed positions relative to a structure, comprising (a) a first connecting member adapted for mounting to the door;

(b) a second connecting member adapted for mounting to the structure;

(c) a first balancing arm connected with said second connecting member via a first fixed pivot connection;

(d) a second balancing arm connected at one end with said second connecting member via a second fixed pivot, said first fixed pivot being arranged above and within the structure relative to the second fixed pivot;

(e) a first arm having one end connected with an end of said first balancing arm opposite said first fixed pivot via a first mobile pivot and a second end connected with said first connecting member via a second mobile pivot, said second balancing arm being connected at another end with said first connecting member via a third mobile pivot; and (f) a spring connected between said second connecting member and said first balancing arm for providing a force to said first balancing arm to counteract the weight of the door, said first balancing arm including a pin which engages an end of said spring when the door is in the horizontal open position; and (g) a follower connecting said spring with said second connecting member, said first arm having a cam surface for engaging said follower when the door is adjacent to the closed condition, said cam surface being configured to provide a removable stop for the door in a partial opening condition.

8. A fulcrum type door hinge as defined in claim 7, wherein said follower comprises a body portion having a pivot for pivotally connecting said body with said second connecting member, one end of said body being connected with said spring and another end of said body including an idler wheel which rotates along the cam surface in response to a force from said spring.

9. A fulcrum type door hinge as defined in claim 8, wherein said follower body includes a second pivot and said second connecting member contains a slot for receiving said second pivot for limiting oscillating movement of said body.

10. A fulcrum type door hinge as defined in claim 7, and further comprising a guide for said spring, said guide being connected with said second connecting member and receiving a portion of said spring.

11. A fulcrum type door hinge as defined in claim 10, wherein said first balancing arm includes a first limit stop to engage a portion of said guide of said second connecting member when the door is in the open condition.

12. A fulcrum type door hinge as defined in claim 11, wherein said first arm includes a second limit stop to engage a portion of said first connecting member when the door is in the open condition.

13. A fulcrum type door hinge as defined in claim 12, wherein said first arm includes a third limit stop adjacent to said first mobile pivot for engaging a stop on said second balancing arm when the door is in the open condition.

14. A fulcrum type door hinge permitting movement of a door between horizontal open and vertical closed positions relative to a structure, comprising (a) a first connecting member adapted for mounting to the door;

(b) a second connecting member adapted for mounting to the structure;

(c) a first balancing arm connected with said second connecting member via a first fixed pivot connection in a mid-portion of said first balancing arm;

(d) a second balancing arm connected at one end with said second connecting member via a second fixed pivot, said first fixed pivot being arranged above and within the structure relative to the second fixed pivot; and (e) a first arm having one end connected with an end of said first balancing arm opposite said first fixed pivot via a first mobile pivot and a second end connected with said first connecting member via a second mobile pivot, said second balancing arm being connected at another end with said first connecting member via a third mobile pivot, said first arm having a protrusion adjacent to said second mobile pivot, said protrusion extending from said first arm in the direction of said first connection member for sliding on a flat surface of the first connecting member to reduce gaps and oscillations in the hinge.

15. A fulcrum type door hinge permitting movement of a door between horizontal open and vertical closed positions relative to a structure, comprising (a) a first connecting member adapted for mounting to the door;

(b) a second connecting member adapted for mounting to the structure;

(c) a first balancing arm connected with said second connecting member via a first fixed pivot connection in a mid-portion of said first balancing arm;

(d) a second balancing arm connected at one end with said second connecting member via a second fixed pivot, said first fixed pivot being arranged above and within the structure relative to the second fixed pivot;

(e) a first arm having one end pivotally connected with an end of said first balancing arm opposite said first fixed pivot and a second end pivotally connected with said first connecting member, said second balancing arm being pivotally connected at another end with said first connecting member; and (f) an assembly for removably connecting said first connecting member with the door, said assembly including a cavity having an open lower end, said cavity receiving a protrusion on said first connecting member and a protrusion of said second mobile pivot.

16. A fulcrum type door hinge permitting movement of a door between horizontal open and vertical closed positions relative to a structure, comprising (a) a first connecting member adapted for mounting to the door;

(b) a second connecting member adapted for mounting to the structure;

(c) a first balancing arm connected with said second connecting member via a first fixed pivot connection;

(d) a second balancing arm connected at one end with said second connecting member via a second fixed pivot, said first fixed pivot being arranged above and within the structure relative to the second fixed pivot;

(e) a first arm having one end connected with an end of said first balancing arm opposite said first fixed pivot via a first mobile pivot and a second end connected with said first connecting member via a second mobile pivot, said second balancing arm being connected at another end with said first connecting member via a third mobile pivot, said first connecting member including a first seat opposite to said first mobile pivot; and (f) an assembly for removably connecting said first connecting member with the door, said assembly including a cavity having an open lower end, said cavity receiving a protrusion on said first connecting member and a protrusion of said second mobile pivot, said assembly including a first assembly pivot which engages said first connecting member first seat and a manually operable stop for blocking said first seat relative to said first assembly pivot.

17. A fulcrum type door hinge as defined in claim 16, wherein said first connecting member includes a second seat for a second assembly pivot of said assembly.

18. A fulcrum type door hinge as defined in claim 17, wherein said first connecting member includes a third seat on an external portion thereof adjacent to said third mobile pivot for engaging a border portion of said assembly.

19. A fulcrum type door hinge as defined in claim 18, wherein said first, second and third seats open upwardly when the door is in the closed condition.

20. A fulcrum type door hinge as defined in claim 16, and further comprising an assembly arm having one end rotatably connected with said first arm via a pivot and manually movable to engage an edge of said second connecting member to lock the first connecting member in a position for easy connection of the assembly with the door.

* * * * *